US011293268B2

(12) United States Patent
Aljeaban et al.

(10) Patent No.: US 11,293,268 B2
(45) Date of Patent: Apr. 5, 2022

(54) DOWNHOLE SCALE AND CORROSION MITIGATION

(71) Applicant: Saudi Arabian Oil Company, Dhahran (SA)

(72) Inventors: Norah Abdullah Aljeaban, Dhahran (SA); Bader Ghazi Al-Harbi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/922,653

(22) Filed: Jul. 7, 2020

(65) Prior Publication Data

US 2022/0010654 A1 Jan. 13, 2022

(51) Int. Cl.

| | |
|---|---|
| ***E21B 37/06*** | (2006.01) |
| ***E21B 34/06*** | (2006.01) |
| ***E21B 41/02*** | (2006.01) |
| ***E21B 47/00*** | (2012.01) |

(52) U.S. Cl.

CPC ..... *E21B 37/06* (2013.01); *E21B 34/06* (2013.01); *E21B 41/02* (2013.01); *E21B 47/00* (2013.01)

(58) Field of Classification Search

CPC ..... E21B 37/06; E21B 17/003; E21B 34/066; E21B 34/08; E21B 34/16; E21B 41/02; E21B 43/123; E21B 43/14; E21B 43/25; E21B 47/00; E21B 47/12; E21B 47/13; E21B 49/00; E21B 34/06

See application file for complete search history.

(56) References Cited

U.S. PATENT DOCUMENTS

| | | | | |
|---|---|---|---|---|
| 5,881,807 | A * | 3/1999 | Bøe | E21B 27/02 166/100 |
| 6,981,553 | B2 | 1/2006 | Stegemeier et al. | |
| 7,617,873 | B2 | 11/2009 | Lovell et al. | |
| 7,711,486 | B2 | 5/2010 | Thigpen et al. | |
| 7,805,248 | B2 | 9/2010 | Thigpen et al. | |
| 8,682,589 | B2 | 3/2014 | Thigpen et al. | |
| 8,863,833 | B2 | 10/2014 | Mescall et al. | |
| 9,062,518 | B2 | 6/2015 | Patel et al. | |
| 9,382,466 | B2 * | 7/2016 | Koskan | E21B 47/00 |
| 9,528,369 | B2 | 12/2016 | Brown | |
| 9,624,763 | B2 * | 4/2017 | Samuelson | E21B 17/028 |
| 10,221,685 | B2 | 3/2019 | Bartetzko et al. | |
| 11,002,111 | B2 * | 5/2021 | BuGubaia | F16K 17/16 |

(Continued)

*Primary Examiner* — Daniel P Stephenson

(74) *Attorney, Agent, or Firm* — Bracewell LLP; Constance G. Rhebergen; Linda L. Morgan

(57) ABSTRACT

Systems and methods for delivering inhibitor fluid downhole within a subterranean well include an injection tool. The injection tool has an injection tool body that is an elongated member with an interior storage space. An injector valve is moveable between a closed position where the inhibitor fluid located within the interior storage space is prevented from exiting the interior storage space past the injector valve, and an open position where the injector valve provides a fluid flow path for the inhibitor fluid located within the interior storage space to exit the interior storage space through the injector valve. A water sensor is in signal communication with the injector valve. A refill line extends from an inhibitor fluid storage tank to the interior storage space. A support member suspends the injection tool within the subterranean well.

6 Claims, 1 Drawing Sheet

(56) References Cited

U.S. PATENT DOCUMENTS

| | | | | |
|---|---|---|---|---|
| 2010/0300684 | A1 | 12/2010 | Kotsonis et al. | |
| 2011/0162841 | A1 | 7/2011 | Wilson | |
| 2014/0000889 | A1 | 1/2014 | Cresswell et al. | |
| 2019/0048712 | A1 | 2/2019 | Jennings et al. | |
| 2019/0316440 | A1* | 10/2019 | Honeker | E21B 34/066 |
| 2020/0131883 | A1* | 4/2020 | Arsalan | E21B 47/06 |

* cited by examiner

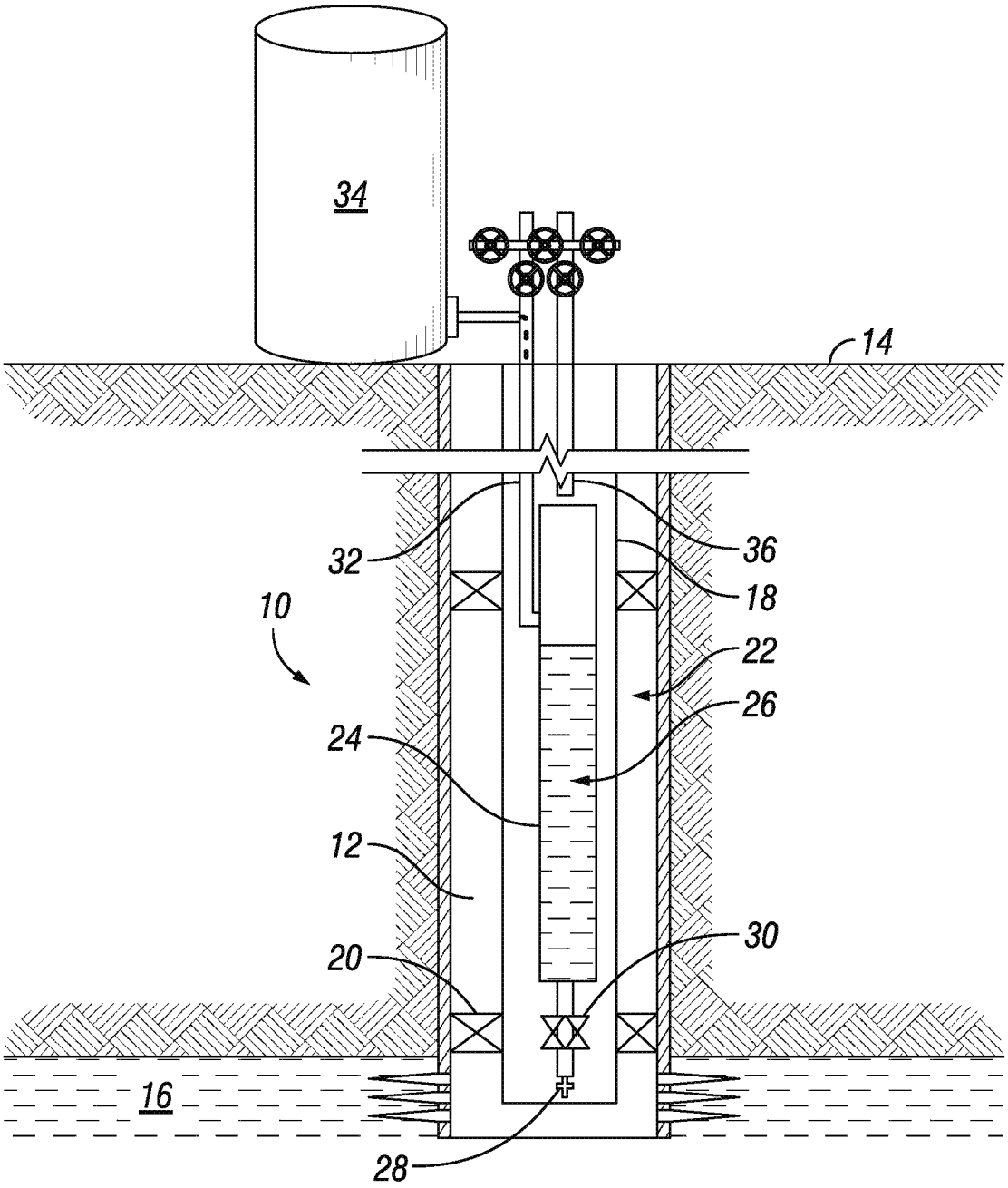
34
14
32
36
18
10
22
26
24
12
30
20
16
28

DOWNHOLE SCALE AND CORROSION MITIGATION

BACKGROUND OF THE DISCLOSURE

1. Field of the Disclosure

The present disclosure relates to subterranean well development, and more specifically, the disclosure relates to the delivery of scale and corrosion inhibitor into the subterranean well.

2. Description of the Related Art

When water is produced from a subterranean well with the production of hydrocarbons, the water will travel to the surface with the hydrocarbons. The produced water can cause mineral scale deposition, corrosion, emulsion, and result in hydrates. The scale can be deposited all along the water path from the subterranean reservoir to the surface equipment.

The rate of scale deposition will be increased with the water production and if there is no water, no inorganic scales will be formed.

SUMMARY OF THE DISCLOSURE

In embodiments of the current application inhibitor fluids are located within an injection tool that is positioned downhole. The inhibitor fluids will not be released unless and until water is detected by a water sensor. In some currently available inhibitor delivery systems, inhibitor fluids are provided constantly. However, by only releasing inhibitor fluids when water is present, the amount of inhibitor fluids used is optimized. In addition, by releasing inhibitor fluid from an injection tool that is located downhole, the delivery of the inhibitor fluid is immediate, without requiring the time to travel downhole from the surface, as in some currently available inhibitor delivery systems.

In an embodiment of this disclosure, a system for delivering inhibitor fluid downhole within a subterranean well includes an injection tool. The injection tool has an injection tool body that is an elongated member with an interior storage space. An injector valve is moveable between a closed position where the inhibitor fluid located within the interior storage space is prevented from exiting the interior storage space past the injector valve, and an open position where the injector valve provides a fluid flow path for the inhibitor fluid located within the interior storage space to exit the interior storage space through the injector valve. A water sensor is in signal communication with the injector valve. A refill line extends from an inhibitor fluid storage tank to the interior storage space. A support member suspends the injection tool within the subterranean well.

In alternate embodiments, the injection tool can be located within a production tubular that extends within the subterranean well. The water sensor can be located at a production fluid entrance to a production tubular. The inhibitor fluid that is located within the interior storage space can have a pressure that is larger than a pressure within the subterranean well at a location of the injector valve. The injector valve can be a normal closed valve that is moveable to the open position in response to a signal from the water sensor.

In an alternate embodiment of this disclosure, a method for delivering inhibitor fluid downhole within a subterranean well includes suspending an injection tool within the subterranean well with a support member. The injection tool has an injection tool body that is an elongated member with an interior storage space. An amount of water within the subterranean well is sensed with a water sensor of the injection tool. An injector valve is moved between a closed position where the inhibitor fluid located within the interior storage space is prevented from exiting the interior storage space past the injector valve, and an open position where the injector valve provides a fluid flow path for the inhibitor fluid located within the interior storage space to exit the interior storage space through the injector valve. The interior storage space of the injection tool is refilled with inhibitor fluid by way of a refill line extending from an inhibitor fluid storage tank to the interior storage space.

In alternate embodiments, the injection tool can be positioned within a production tubular that extends within the subterranean well. The injection tool can be positioned within the subterranean well such that the water sensor is located at a production fluid entrance to a production tubular. A pressure of the inhibitor fluid located within the interior storage space can be maintained at a pressure larger than a pressure within the subterranean well at a location of the injector valve. The injector valve can be a normal closed valve, and the method can further include moving the injector valve to the open position in response to a signal from the water sensor.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

The FIGURE is a schematic sectional view of a subterranean well with an injection tool in accordance with an embodiment of this disclosure.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

As used in this Specification, the term "substantially equal" means that the values being referenced have a difference of no more than two percent of the larger of the values being referenced.

Where reference is made in the specification and appended Claims to a method comprising two or more defined steps, the defined steps can be carried out in any order or simultaneously except where the context excludes that possibility.

Looking at the FIGURE, subterranean well 10 can have wellbore 12 that extends to an earth's surface 14. Wellbore 12 can be drilled from surface 14 and into and through various formation zones of subterranean formations. Subterranean well 10 can be an offshore well or a land based well and can be used for producing hydrocarbons from subterranean hydrocarbon reservoir 16.

Fluids from reservoir 16 can enter wellbore 12 through perforations or fractures that extend from wellbore 12 into reservoir 16. The production fluids can enter production tubing 18 to be produced to the surface. Production tubing 18 can extend from surface 14 into wellbore 12 of subterranean well 10. Packers 20 can seal the annular space defined by the outer diameter surface of production tubing 18 and the inner diameter surface of wellbore 12. Packers 20 can prevent fluids from traveling axially through the annular space past packers 20. Therefore, the production fluids of the embodiment of the FIGURE are directed through production tubing 18 to be produced to the surface.

In the embodiment of the FIGURE, production tubing 18 has an open downhole end that acts as a production entrance. Production fluids can enter production tubing 18 through the production entrance. In alternate embodiments, the production entrance may be in the form of a screen or perforations through a sidewall of the production tubing.

There may be times during the operation of subterranean well 10 that water is produced as part of the production fluids. The water may travel through production tubing 18 and be produced to the surface, which exposes the hydrocarbons, the production tubing, and the equipment and tools through which the production fluids flow to water. The water can, for example, cause mineral scale deposition, corrosion, emulsion, and result in the formation of hydrates.

Injection tool 22 can be used to mitigate the effects of producing water. Injection tool 22 can deliver inhibitor fluid downhole within subterranean well 10. The inhibitor fluid can be a chemical agent that is formulated to prevent corrosion, prevent the buildup of scale, separate components of a potential or actual emulsion, prevent the formation of hydrates, or any combination of such formulations.

Injection tool 22 can be located within production tubing 18 that extends from the surface. Injection tool 22 can include injection tool body 24. Injection tool body 24 is an elongated member. The outer dimension of injection tool body 24 is sufficiently smaller than an inner diameter dimension of production tubing 18 so that produced fluids can flow through production tubing 18 to the surface without being blocked by injection tool 22. Injection tool body 24 has interior storage space 26. Interior storage space 26 can be sized to contain sufficient inhibitor fluid to treat the produced fluids without having to deliver more inhibitor fluids from the surface, which amount will be dependent on the conditions of the reservoir and the type of the inhibitor fluid.

Injection tool 22 can further include injector valve 28. Injector valve 28 is in fluid communication with interior storage space 26 of injection tool body 24. Injector valve 28 has a closed position and an open position. In the closed position, the inhibitor fluid located within interior storage space 26 is prevented from exiting interior storage space 26 past injector valve 28. In certain embodiments, injector valve 28 can be a normal closed valve.

In the open position, injector valve 28 provides a fluid flow path for the inhibitor fluid located within interior storage space 26 to exit interior storage space 26 through injector valve 28. The inhibitor fluid located within interior storage space 26 can be maintained at a pressure that is larger than a pressure within wellbore 12 of subterranean well 10 at the location of injector valve 28. In this way, when injector valve 28 is moved to an open position, the inhibitor fluid located within interior storage space 26 will automatically exit interior storage space 26 through injector valve 28. The inhibitor fluid exiting interior storage space 26 will mix with the production fluids, can react with the production fluids, and can travel with the production fluids to the surface through production tubing 18. In particular, the inhibitor fluid exiting interior storage space 26 can treat the production fluids to mitigate the scale, corrosion, and other potential negative consequences of any water being present in the production fluids.

Injection tool 22 also has water sensor 30. Water sensor 30 can sense the presence of a baseline amount of water within the production fluids. Water sensor 30, for example, can use methods that measure the density or viscosity of the production fluids to determine the amount of water in the production fluid. Water sensor 30 can be sufficiently sensitive to detect any amount of water, in order to prevent the initial formation of scale or corrosion. Water sensor 30 can be located at or proximate to the production fluid entrance of production tubular 18. Water sensor 30 can detect the water in the production fluids as the production fluids are entering production tubular 18.

Water sensor 30 is in signal communication with injector valve 28. Injector valve 28 can be moved to the open position in response to a signal from water sensor 30. In certain embodiments where injector valve 28 is a normal closed valve, injector valve 28 will remain in the closed position until a signal from water sensor 30 causes injector valve 28 to move the open position. In such an embodiment, upon a lack of signal from water sensor 30, injector valve 28 will return to the normal closed position.

In certain embodiments, injector valve 28 can be open only for a minimal amount of time. The minimal amount of time will be less than the time it would take for the pressure within interior storage space 26 to equalize with the pressure within wellbore 12 at the location of injector valve 28. Injector valve 28 can remain open for the slow release of inhibitor fluid for as long as water is detected in the production fluid.

After inhibitor fluid has exited interior storage space 26 and injector valve 28 has returned to the closed position, the pressure within interior storage space 26 can be increased and additional inhibitor fluid can be added to interior storage space 26.

Refill line 32 can be used to pressurize interior storage space 26 and add additional inhibitor fluid to interior storage space 26. Refill line 32 can extend from inhibitor fluid storage tank 34 to interior storage space 26. Refill line 32 can also be a support member, supporting injection tool 22 within subterranean well 10. Alternately, a separate support member can support injection tool 22 within subterranean well 10.

The inhibitor fluid can be pumped by a surface pump from inhibitor fluid storage tank 34 to interior storage space 26. The inhibitor fluid can be maintained within interior storage space 26 by the surface pump at a pressure that is larger than a pressure within wellbore 12 of subterranean well 10 at the location of injector valve 28.

In an example of operation, injection tool 22 can be made part of a completion system for delivering inhibitor fluid downhole within subterranean well 10. Injection tool 22 can be delivered into wellbore 12 and suspended within subterranean well 10. During operation of subterranean well 10, fluids are produced from reservoir 16 through production tubing 36. Production tubing 36 is separate from injection tool 22 and is not connected to injection tool 22. During operation of subterranean well 10, as fluids are produced from reservoir 16, water sensor 30 can detect an amount of water that is present in the produced fluids.

Upon detection of a threshold amount of water within the produced fluids, water sensor 30 can signal injector valve 28 to move to an open position. This signal can be generated by water sensor 30, and injector valve 28 can be moved to the open position automatically without operator intervention.

With injector valve 28 in an open position, inhibitor fluid that is contained within interior storage space 26 of injection tool 22 will be released into subterranean well 10. The inhibitor fluid can prevent the formation of scale that could result from the presence of water, before such scale has an opportunity to form. The inhibitor fluid can prevent the formation of scale within production tubular 18 and along other segments of the fluid flow path of the produced fluids. As an example, the inhibitor fluid can prevent the formation of scale formed by carbonates, sulfates, and sulfides, as well as other possible scale-building matter.

The inhibitor can further mitigate the corrosive effects of water within production tubular 18 and along other segments of the fluid flow path of the produced fluids. The inhibitor fluid can, for example prevent the start of a corrosive process before the water has an opportunity to corrode equipment and tools that are part of the hydrocarbon development.

After the inhibitor fluid has been released into wellbore 12, refill line 32 can be used to refill interior storage space 26 with inhibitor fluid and to pressurize interior storage space 26 to a pressure that is larger than a pressure within wellbore 12 of subterranean well 10 at the location of injector valve 28.

The inhibitor fluids will not be released from interior storage space 26 unless there is produced water that is detected by water sensor 30. Therefore the inhibitor fluid is not being wasted by being injected without any water being present. In particular, the use of the inhibitor fluid on an as-needed basis will reduce the amount of inhibitor fluid used compared to currently available methods that squeeze large volumes of inhibitor fluids into the downhole reservoir.

Because injection tool 22 is located downhole, the delivery of the inhibitor fluid downhole can be accomplished immediately, instead of having a time delay that would be caused by delivering the inhibitor fluids from the surface. In addition, because the determination of the need for the inhibitor fluid is being determined by water sensor 30 in a real-time basis, the systems and methods of this disclosure are not subject to potential computer modeling errors that may miscalculate when an inhibitor could be needed, which is a risk in some currently available systems.

Embodiments of this disclosure therefore provide systems and methods for injecting an inhibitor fluid locally downhole. The injection of the inhibitor fluid can be continuous, if water is continuously detected. The injection of the inhibitor fluid can also be stopped and started based on the detection of water by water sensor 30.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for delivering inhibitor fluid downhole within a subterranean well, the system including:

an injection tool located within a central bore of a production tubular, the injection tool having an injection tool body that is an elongated member with an interior storage space sized to contain a sufficient amount of inhibitor fluid for treating a produced fluid, and where the production tubular delivers the produced fluid to the surface;

an injector valve, the injector valve moveable between a closed position where the inhibitor fluid located within the interior storage space is prevented from exiting the interior storage space past the injector valve, and an open position where the injector valve provides a fluid flow path for the inhibitor fluid located within the interior storage space to exit the interior storage space through the injector valve;

a water sensor in signal communication with the injector valve, where the water sensor is located within the production tubular at a production fluid entrance to the production tubular;

a refill line extending from an inhibitor fluid storage tank to the interior storage space; and a support member extending through a central bore of the production tubular and suspending the injection tool within the production tubular of the subterranean well.

2. The system of claim 1, where the inhibitor fluid located within the interior storage space has a pressure that is larger than a pressure within the subterranean well at a location of the injector valve.

3. The system of claim 1, where the injector valve is a normal closed valve that is moveable to the open position in response to a signal from the water sensor.

4. A method for delivering inhibitor fluid downhole within a subterranean well, the method including:

suspending an injection tool within a central bore of a production tubular of the subterranean well with a support member that extends through a central bore of the production tubular, the injection tool having an injection tool body that is an elongated member with an interior storage space, the interior storage space sized to contain a sufficient amount of inhibitor fluid for treating a produced fluid, and where the production tubular delivers the produced fluid to the surface;

positioning the injection tool within the subterranean well such that the water sensor is located at a production fluid entrance to the production tubular;

sensing an amount of water within the subterranean well with a water sensor of the injection tool;

moving an injector valve between a closed position where the inhibitor fluid located within the interior storage space is prevented from exiting the interior storage space past the injector valve, and an open position where the injector valve provides a fluid flow path for the inhibitor fluid located within the interior storage space to exit the interior storage space through the injector valve; and refilling the interior storage space of the injection tool with inhibitor fluid by way of a refill line extending from an inhibitor fluid storage tank to the interior storage space.

5. The method of claim 4, further including maintaining a pressure of the inhibitor fluid located within the interior storage space larger than a pressure within the subterranean well at a location of the injector valve.

6. The method of claim 4, where the injector valve is a normal closed valve, the method further including moving the injector valve to the open position in response to a signal from the water sensor.

* * * * *